US007443289B2

(12) United States Patent
Smith

(10) Patent No.: US 7,443,289 B2
(45) Date of Patent: Oct. 28, 2008

(54) AUTOMATIC DETECTION OF MICROPHONE SABOTAGE IN A SECURITY SYSTEM DEVICE

(75) Inventor: Richard A Smith, El Dorado Hills, CA (US)

(73) Assignee: Honeywell International Inc., Morristown, NJ (US)

( * ) Notice: Subject to any disclaimer, the term of this patent is extended or adjusted under 35 U.S.C. 154(b) by 131 days.

(21) Appl. No.: 11/432,581

(22) Filed: May 10, 2006

(65) Prior Publication Data

US 2007/0262858 A1 Nov. 15, 2007

(51) Int. Cl.
*G08B 29/00* (2006.01)

(52) U.S. Cl. ..... 340/506; 340/511; 340/540; 340/566

(58) Field of Classification Search ..... 340/506, 340/507, 511, 566, 384.7, 384.73, 540; 381/56, 381/58

See application file for complete search history.

(56) References Cited

U.S. PATENT DOCUMENTS 4,654,642 A * 3/1987 Groff ..... 340/573.1
5,515,029 A * 5/1996 Zhevelev et al. ..... 340/540
5,812,054 A * 9/1998 Cohen ..... 340/506
6,229,455 B1 * 5/2001 Yost et al. ..... 340/943
2003/0080867 A1 * 5/2003 Simon ..... 340/507
2005/0265571 A1 * 12/2005 Smith et al. ..... 381/355

* cited by examiner

*Primary Examiner*—Thomas J Mullen, Jr.
(74) *Attorney, Agent, or Firm*—Anthony R. Barkume

(57) ABSTRACT

The present invention automatically detects the sabotage of an audio transducer such as a microphone in a security system device. An audio transducer generates an electrical signal, which is analyzed to determine if the electrical signal exhibits a predetermined sabotage characteristic. If the electrical signal does exhibit a predetermined sabotage characteristic, then an alarm device trouble signal is transmitted to an alarm control panel for further processing. If, however, the electrical signal does not exhibit a predetermined sabotage characteristic, then the electrical signal is analyzed to determine if the electrical signal exhibits a predetermined alarm characteristic. If the electrical signal does exhibit a predetermined alarm characteristic, then an alarm signal is transmitted to the alarm control panel for further processing.

10 Claims, 3 Drawing Sheets

AUTOMATIC DETECTION OF MICROPHONE SABOTAGE IN A SECURITY SYSTEM DEVICE

TECHNICAL FIELD

This invention relates to microphone-based security system devices, and in particular to the automatic detection of sabotage to the microphone.

BACKGROUND ART

Audio-based security system devices such as glassbreak detectors and listen-in devices utilize an audio transducer such as a microphone to sense acoustic waves and process the sensed acoustic waves in accordance with the requirements of the device. For example, a glassbreak detector will sense acoustic waves, process and analyze them to determine if the waves are the result of a glass breakage event, and then notify a control panel accordingly. A listen-in device uses a microphone to pick up sounds in a protected area and either convey those sounds in real time to a central station operator, record the sounds for archival purpose, or both. In either case, the operation of the microphone as an acoustic transducer is critical in the proper functioning of the device.

Thus, intruders may sabotage the microphone in an attempt to disable or render useless the security system device. For example, by destroying a microphone in a glassbreak detector, the intruder will have disabled the alarm capabilities of the detector and thus compromised the area under surveillance by that detector.

One method of sabotage that is tested (for example in European certification test labs) is the puncturing of the microphone diaphragm. In order to ascertain sabotage of the microphone, a visual (mechanical) inspection of the microphone maybe utilized. This may be disadvantageous since it requires the microphone to be inspected. Since sabotage may occur just prior to an intrusion, reliance on periodic visual inspections may not be effective.

Thus, it is desired to provide an automatic manner of detecting if a microphone has been sabotaged such as by damage to the diaphragm.

DISCLOSURE OF THE INVENTION

Accordingly, the present invention automatically detects the sabotage of an audio transducer such as a microphone in a security system device. At any time an audio transducer generates an electrical signal, the signal will be analyzed to determine if the electrical signal exhibits a predetermined sabotage characteristic. If the electrical signal does exhibit a predetermined sabotage characteristic, then an alarm device trouble signal is transmitted to an alarm control panel for further processing. If, however, the electrical signal does not exhibit a predetermined sabotage characteristic, then the electrical signal is analyzed to determine if the electrical signal exhibits a predetermined alarm characteristic. If the electrical signal does exhibit a predetermined alarm characteristic, then an alarm signal is transmitted to the alarm control panel for further processing.

The electrical signal may be analyzed digitally or with dedicated analog circuitry to determine if it exhibits a predetermined sabotage characteristic. In either case, in a first embodiment, the presence of a first voltage transition of the electrical signal in the positive direction exceeding a first predetermined voltage threshold and lasting within a first predetermined period of time is determined. A second voltage transition of the electrical signal in the negative direction exceeding a second predetermined threshold and lasting within a second predetermined period of time is also determined. If the second voltage transition occurs within a third predetermined time after the first voltage transition, then the electrical signal has exhibited a predetermined sabotage characteristic.

In a second embodiment, the presence of a first voltage transition of the electrical signal in the negative direction exceeding a first predetermined voltage threshold and lasting within a first predetermined period of time is determined. A second voltage transition of the electrical signal in the positive direction exceeding a second predetermined threshold and lasting within a second predetermined period of time is also determined. If the second voltage transition occurs within a third predetermined time after the first voltage transition, then the electrical signal has exhibited a predetermined sabotage characteristic.

BEST MODE FOR CARRYING OUT THE INVENTION

Figure 1:
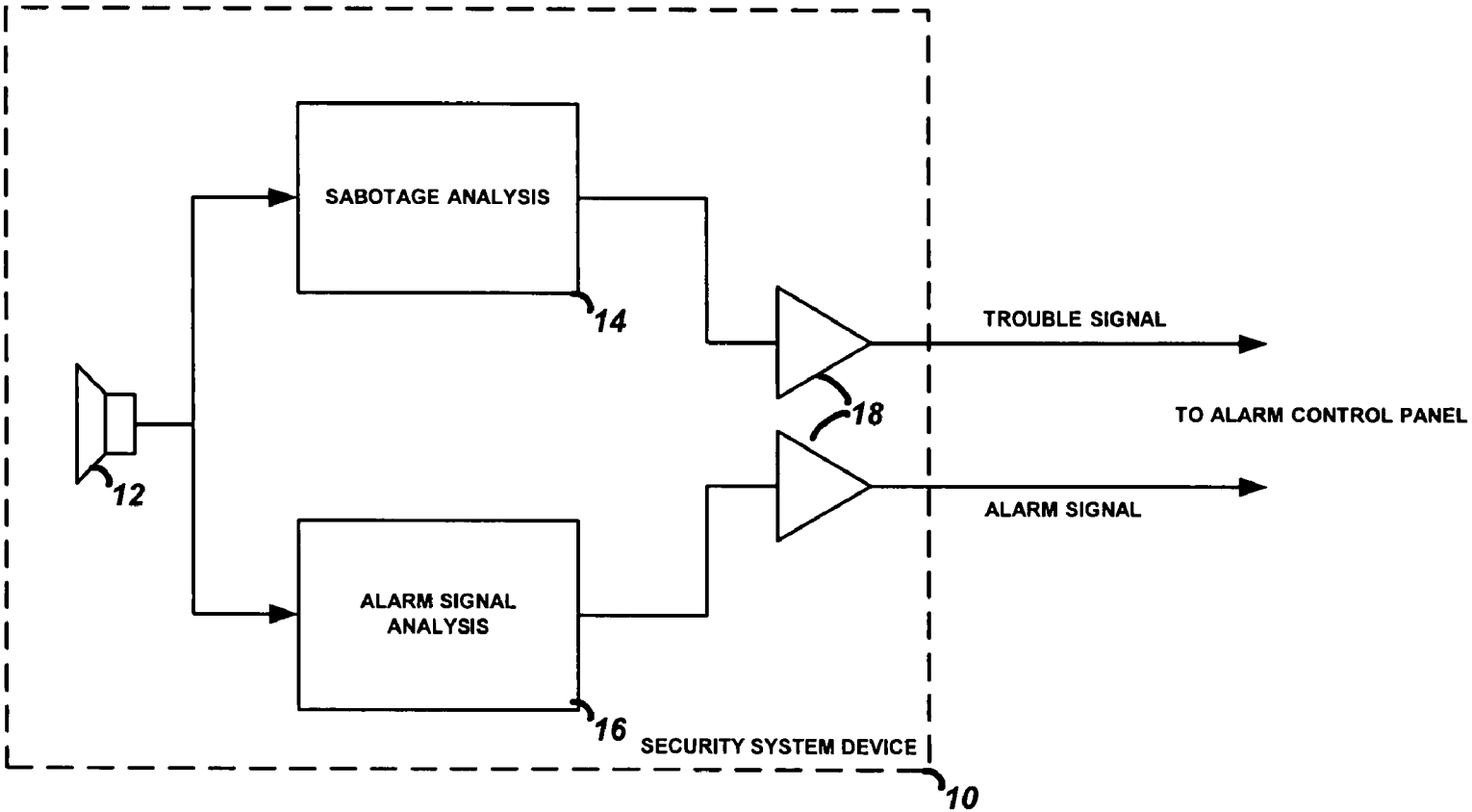
FIG. 1 is a block diagram of the present invention.

The present invention is now described in detail with respect to the Figures. A security system device 10 operating in accordance with the present invention is shown in basic block diagram in FIG. 1. A microphone 12 is used to detect acoustic signals emanating from a protected region. Sabotage analysis circuitry 14 and alarm signal analysis circuitry 16 will analyze the signal, as described herein, to ascertain the presence of a sabotage attempt on the microphone 12 or if an alarm condition has occurred. If either occurs, then an appropriate message is generated and transmitted by transmitter(s) 18 (which may be wireless or part of a bus or loop wired system as well known in the art) to an alarm control panel for further processing.

There are two basic types of microphones used in security system devices such as the glassbreak detector and the listen-in device described above; an electret microphone and a back electret microphone. In either case, a JFET transistor or optionally a high input impedance operational amplifier is used to buffer the device. In either type of device (and with either type of buffering means), the present invention is applied to determine when the microphone has been sabotaged in an attempt to compromise the diaphragm.

When an instrument small enough to enter a hole in the microphone case is used to puncture or significantly damage the diaphragm, then the diaphragm will come into contact with the backplate. When this occurs, a large step in voltage will occur. The voltage step will transition in one direction briefly, and then transition in the opposite direction. The initial direction (i.e. positive or negative) will depend on the type of microphone used (electret or back electret) as well as the buffering method described above.

In the case of an electret microphone, the diaphragm is polarized (i.e. given an electric charge) which is somewhat permanent. The diaphragm is a flexible, pliable film, which is typically Teflon or Mylar (or PPS). The backplate is fabricated from a plated metal which is electrically conductive and has no permanent charge. When the diaphragm is deflected to the point that it comes into contact with the backplate, then a voltage step is generated at the backplate terminal. The voltage step will be negative for the electret type (front electret). When this type is buffered by an op amp, typically configured as a non-inverting voltage follower, the output will be in phase with the signal generated at the backplate terminal. When the signal is JFET buffered, as in the traditional means for an electret microphone, the signal will be inverted. In either case, the step in voltage is quite large and unique in its characteristics. The back electret generates voltages in opposite phase to the electret (at the backplate terminal). Regardless of the phase of the signal, the present invention will detect the unique signal characteristics of the attempt to compromise the microphone diaphragm.

Fundamentally, sabotage is determined by detecting the first high level amplitude microphone signal which is characteristic of the diaphragm being forced into contact with the backplate. The characteristics of this signal which is generated are unique and can be identified as separate from acoustically generated signals. The analysis of the signal proceeds as follows.

Figure 2:
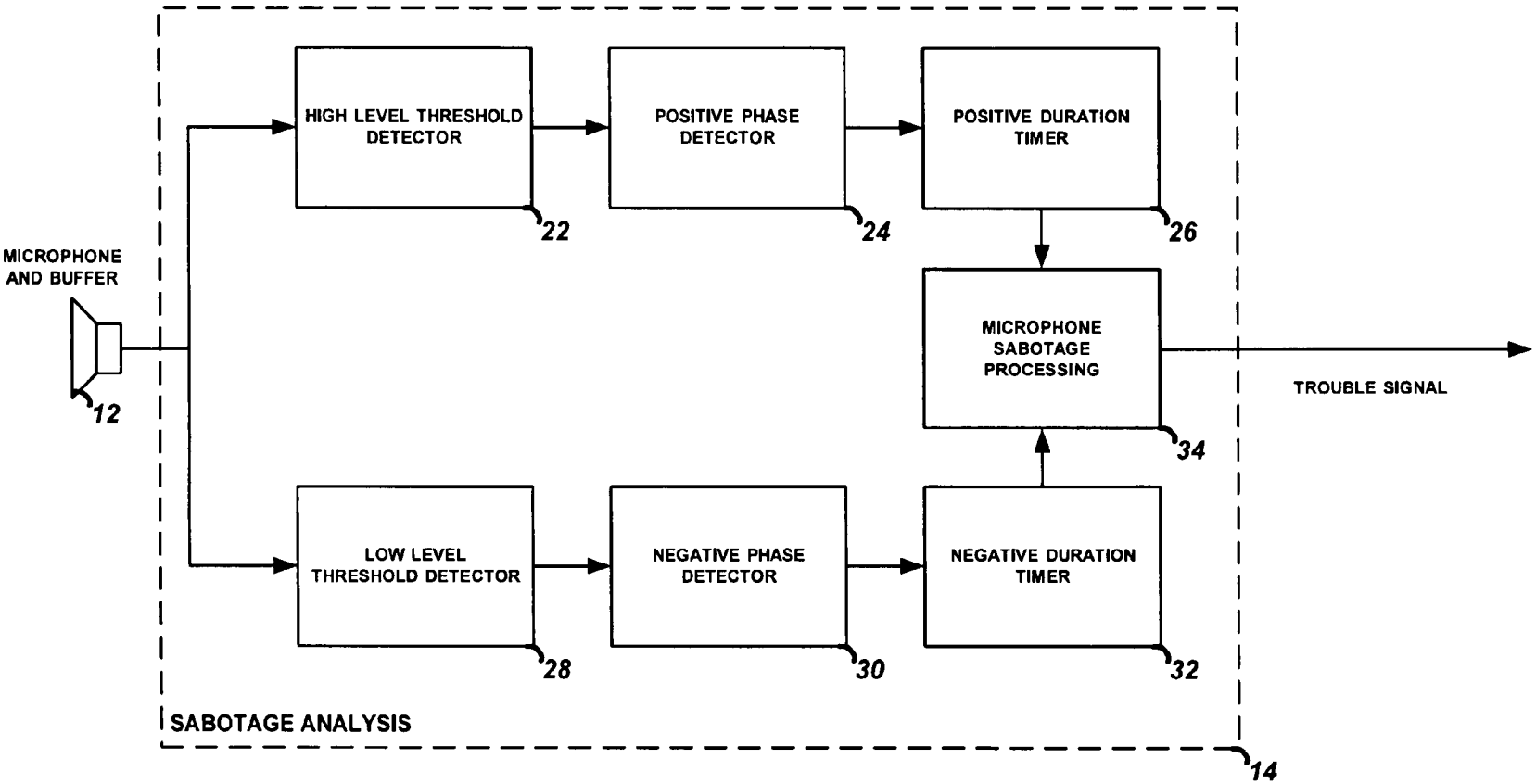
FIG. 2 is a more detailed schematic of the present invention.
Figure 3:
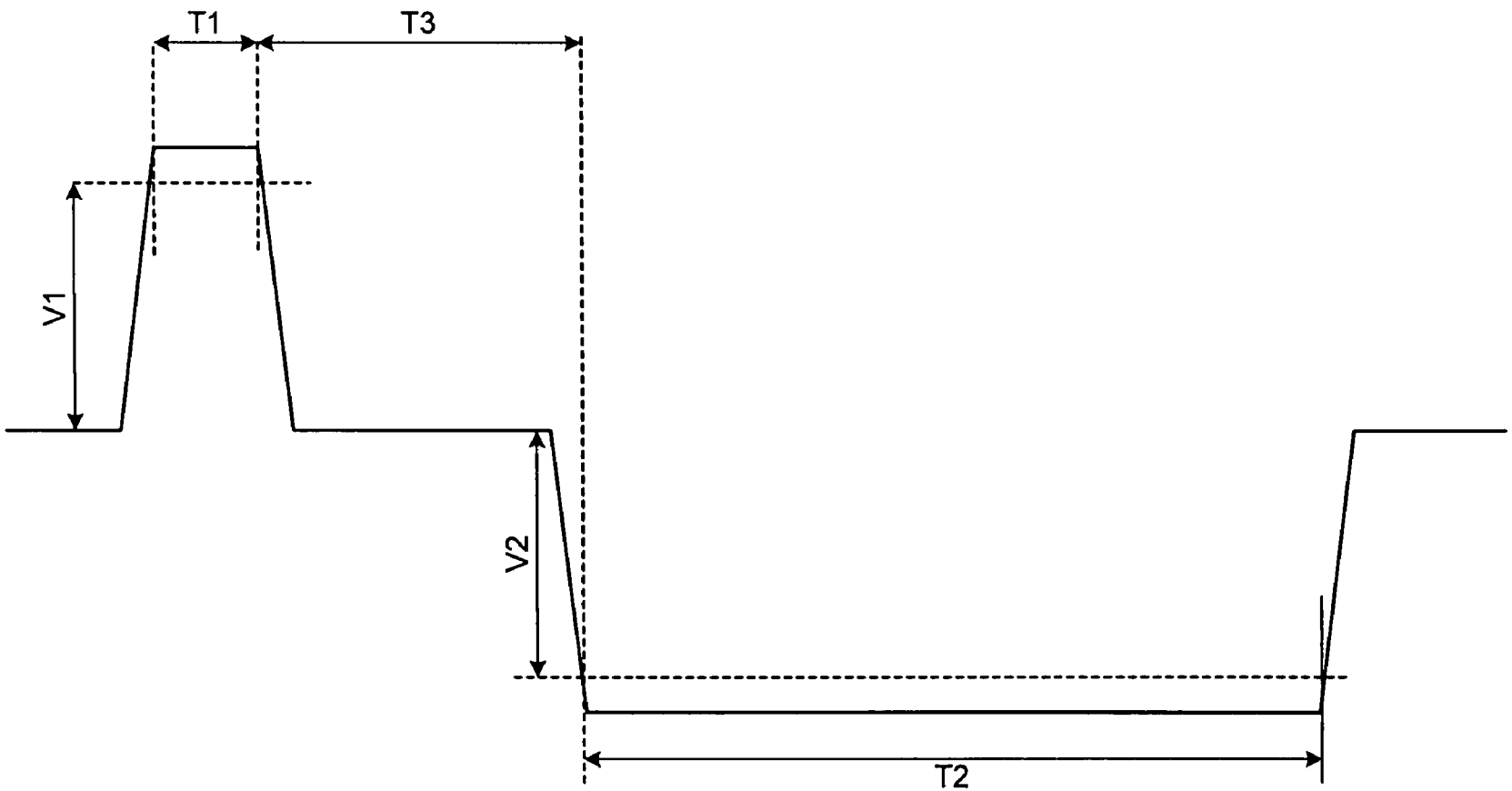
FIG. 3 is an illustration of the voltage waveforms that have been determined to result from microphone sabotage.

In the case of either (1) an electret microphone with a JFET preamp/buffer, or (2) a back electret microphone with an op-amp non-inverting buffer (both generally termed as microphone/buffer 12), a high level threshold detector 22 and a positive phase detector 24 as shown in FIG. 2 will determine if there is a presence of a first voltage transition of the electrical signal in the positive direction that exceeds a predetermined positive voltage threshold V1 (see FIG. 3). A positive duration timer 26 will then determine if the positive transition lasts within a predetermined period of time T1, which in the preferred embodiment is greater than 100 usec and less than 3 msec. In addition, a low level threshold detector 28 and a negative phase detector 30 will determine if there is a presence of a second voltage transition of the electrical signal in the negative direction that exceeds a predetermined negative threshold V2. A negative duration timer 32 will then determine if the negative transition lasts within a predetermined period of time T2, which in the preferred embodiment is greater than 2 msec and less than 1 sec. The microphone sabotage processing circuitry 34 will then determine if the second (negative) voltage transition occurs within a certain time period T3 after the first (positive) voltage transition, which in the preferred embodiment is greater than 1 usec and less than 40 msec. If so, then there has been a microphone sabotage condition and a trouble signal is generated to be transmitted to the alarm control panel indicating the sabotage detection. At the control panel, one or more of several actions may then occur, such as sounding a local siren, sending a message to a central station operator, displaying a sabotage message on a display panel, etc. Note that the waveform shown in FIG. 3 is for illustrative purposes only and is not drawn to scale.

The voltage levels V1 and V2 may be defined in preferred embodiment as thresholds close to the maximum voltage, or minimum voltage, respectively, that the microphone buffer is capable of swinging, as the embodiments would allow, or some significantly large thresholds such as +500 mV and −500 mV. In the alternative, some embodiments may allow for relative thresholds two to three times these values.

Similarly, in the case of either (1) an electret microphone with an op-amp non-inverting buffer, or (2) a back electret microphone with a JFET preamp/buffer, (both generally termed as microphone/buffer 12), the low level threshold detector 28 and the negative phase detector 30 will determine if there is a presence of a first voltage transition of the electrical signal in the negative direction that exceeds a predetermined negative voltage threshold (in this case, the negative transition of FIG. 3 will occur before the positive transition). The negative duration timer 32 will then determine if the negative transition lasts within a predetermined period of time. In addition, the high level threshold detector 22 and the positive phase detector 24 will determine if there is a presence of a second voltage transition of the electrical signal in the positive direction that exceeds a predetermined positive threshold. The positive duration timer 26 will then determine if the positive transition lasts within a predetermined period of time. The microphone sabotage processing circuitry 34 will then determine if the second (positive) voltage transition occurs within a certain time period after the first (negative) voltage transition. If so, then there has been a microphone sabotage condition and a trouble signal is generated to be transmitted to the alarm control panel indicating the sabotage detection. At the control panel, one or more of several actions may then occur, such as sounding a local siren, sending a message to a central station operator, displaying a trouble message on a display panel, etc.

In the event that the above described signal characteristics are not determined by the sabotage analysis circuitry 14, then the signal is not considered to have resulted from microphone sabotage and the signal may then be processed as normal; i.e. analyzed by the alarm signal analysis circuitry 16 to determine if it is a result of glass breakage, as well known in the art.

In the alternative to processing the electrical signals as indicated above with analog circuitry, a digital processing technique may be used to determine the existence of a high level positive transition followed by a low level negative transition (or of a low level negative transition followed by a high level positive transition if desired). Such digital processing techniques are well known in the art and need not be described in full detail herein.

What is claimed is:

1. A method of automatically detecting sabotage of an audio transducer in a security system device comprising the steps of:

a. generating an electrical signal from an audio transducer;

b. analyzing the electrical signal to determine if the electrical signal comprises a predetermined sabotage characteristic; and c. if the electrical signal comprises a predetermined sabotage characteristic, then transmitting an alarm device trouble signal.

2. The method of claim 1 further comprising the steps of d. if the electrical signal does not comprise a predetermined sabotage characteristic, then i. analyzing the electrical signal to determine if the electrical signal comprises a predetermined alarm characteristic; and ii. if the electrical signal comprises a predetermined alarm characteristic, then transmitting an alarm signal.

3. The method of claim 1 wherein the step of analyzing the electrical signal to determine if the electrical signal comprises a predetermined sabotage characteristic comprises the steps of:

i. digitizing the electrical signal to generate a digitized signal, and ii. processing the digitized signal to determine if the electrical signal comprises a predetermined sabotage characteristic.

4. The method of claim 1 wherein the step of analyzing the electrical signal to determine if the electrical signal comprises a predetermined sabotage characteristic comprises the steps of:

i. determining the presence of a first voltage transition of the electrical signal in the positive direction exceeding a first predetermined voltage threshold and lasting for a first predetermined period of time; and ii. determining the presence of a second voltage transition of the electrical signal in the negative direction exceeding a second predetermined threshold and lasting for a second predetermined period of time;

wherein the second voltage transition occurs within a third predetermined time after the first voltage transition.

5. The method of claim 1 wherein the step of analyzing the electrical signal to determine if the electrical signal comprises a predetermined sabotage characteristic comprises the steps of:

i. determining the presence of a first voltage transition of the electrical signal in the negative direction exceeding a first predetermined voltage threshold and lasting for a first predetermined period of time; and ii. determining the presence of a second voltage transition of the electrical signal in the positive direction exceeding a second predetermined threshold and lasting for a second predetermined period of time;

wherein the second voltage transition occurs within a third predetermined time after the first voltage transition.

6. A security system device comprising:

a. an audio transducer adapted to generate an electrical signal as a result of sensing sound;

b. a sabotage analysis processing circuit adapted to analyze the electrical signal to determine if the electrical signal comprises a predetermined sabotage characteristic and then generate an alarm device trouble signal; and c. transmitting circuitry adapted to transmit the alarm device trouble signal generated by the sabotage analysis processing circuit.

7. The device of claim 6 further comprising:

d. an alarm signal analysis processing circuit adapted to analyze the electrical signal to determine if the electrical signal comprises a predetermined alarm characteristic.

8. The device of claim 6 wherein the sabotage analysis processing circuit comprises:

i. digitizing circuitry for digitizing the electrical signal to generate a digitized signal, and ii. processing circuitry adapted to process the digitized signal and determine if the electrical signal comprises a predetermined sabotage characteristic.

9. The device of claim 6 wherein the sabotage analysis processing circuit comprises:

i. a high level threshold detector circuit and a positive phase detector circuit, adapted to determine the presence of a first voltage transition of the electrical signal in the positive direction exceeding a first predetermined voltage threshold;

ii. a positive duration timer circuit adapted to determine if the first voltage transition lasts for a first predetermined period of time;

iii. a low level threshold detector circuit and a negative phase detector circuit, adapted to determine the presence of a second voltage transition of the electrical signal in the negative direction exceeding a second predetermined threshold;

iv. a negative duration timer circuit adapted to determine if the second voltage transition lasts for a second predetermined period of time; and v. a microphone sabotage processing circuit adapted to determine if the second voltage transition occurs within a third predetermined time after the first voltage transition.

10. The device of claim 6 wherein the sabotage analysis processing circuit comprises:

i. a low level threshold detector circuit and a negative phase detector circuit, adapted to determine the presence of a first voltage transition of the electrical signal in the negative direction exceeding a first predetermined voltage threshold;

ii. a negative duration timer circuit adapted to determine if the first voltage transition lasts for a first predetermined period of time;

iii. a high level threshold detector circuit and a positive phase detector circuit, adapted to determine the presence of a second voltage transition of the electrical signal in the positive direction exceeding a second predetermined threshold;

iv. a positive duration timer circuit adapted to determine if the second voltage transition lasts for a second predetermined period of time; and v. a microphone sabotage processing circuit adapted to determine if the second voltage transition occurs within a third predetermined time after the first voltage transition.

* * * * *